US009777536B2

(12) United States Patent
Rockett

(10) Patent No.: US 9,777,536 B2
(45) Date of Patent: Oct. 3, 2017

(54) COLLAPSIBLE KNOCK-OUT PLUG FOR HOLLOW STEM AUGERS AND METHODS OF USE FOR WELL-DRILLING

(71) Applicant: William J. Rockett, Williston, FL (US)

(72) Inventor: William J. Rockett, Williston, FL (US)

( * ) Notice: Subject to any disclaimer, the term of this patent is extended or adjusted under 35 U.S.C. 154(b) by 185 days.

(21) Appl. No.: 14/950,836

(22) Filed: Nov. 24, 2015

(65) Prior Publication Data

US 2017/0145752 A1 May 25, 2017

(51) Int. Cl.
*E21B 10/44* (2006.01)

(52) U.S. Cl.
CPC ..... *E21B 10/44* (2013.01)

(58) Field of Classification Search
CPC ..... E21B 10/44; E21B 33/10; E21B 29/00; E21B 41/00; E21B 12/04; E02D 5/34; E02D 5/38; E02D 5/385
USPC ..... 405/241, 242, 255; 175/307
See application file for complete search history.

(56) References Cited

U.S. PATENT DOCUMENTS 6,264,402 B1 * 7/2001 Vickars ..... E02D 5/36 405/237
7,228,921 B1 * 6/2007 Houg ..... E21B 12/04 175/18

OTHER PUBLICATIONS

Hollow Stem Auger Accessories, Auger Plugs product information, [online, webpage retrieved Jan. 20, 2016] from http://www.holeproducts.com/products/Auger-Plugs?categoryId=179, p. 1.

* cited by examiner

*Primary Examiner* — David Bagnell
*Assistant Examiner* — Yanick Akaragwe
(74) *Attorney, Agent, or Firm* — Saliwanchik, Lloyd & Eisenschenk

(57) ABSTRACT

A knock-out plug having sections held together by a hinge along the top side. The knock-out plug can bend or fold along a crease in the bottom side when force is applied to the top side, or hinge side, of the plug. Conversely, force applied to the bottom side and peripheral wall of the knock-out plug tends to hold the sections together. When placed into the opening in an HSA, the edge of the opening and force of the soil against the bottom side during drilling keeps the plug in place and the sections intact. When desired, the knock-out plug can be hit or pounded on the top side, through the HSA channel which causes the plug to fold or bend and be released easily from the opening.

21 Claims, 7 Drawing Sheets

COLLAPSIBLE KNOCK-OUT PLUG FOR HOLLOW STEM AUGERS AND METHODS OF USE FOR WELL-DRILLING

BACKGROUND OF INVENTION

There are several methods by which environmental wells are drilled under various subsurface conditions. In many situations, the preferred methods are those that allow for the installation of well casings in the hole during, typically using Hollow Stem Augers (HSA). This type of auger has a hollow, steel stem or shaft with a continuous, spiraled steel flight, welded onto the exterior. A HSA often has a bit with teeth at the drilling tip that disturbs soil material when rotated, whereupon the spiral flight transports the soil cuttings to the surface. Multiple augers can be attached to form an auger column to reach the desired well depth. This method is best suited for, though is not limited to, use in soils that have a tendency to collapse when disturbed.

A sacrificial bottom or knock-out plug can be installed at the bottom of the HSA to keep out most of the soils and/or water that have a tendency to enter through the bottom of the HSA during drilling. The use of a knock-out plug can eliminate the need for a drill rod, which can also be used to keep dirt and water out of the HSA. Augering without a drill rod or knock-out plug can also be done, provided that the soil plug, formed in the bottom of the HSA during drilling, is removed before sampling or before final installation of the well casing. Otherwise, when the auger is reversed and removed from the well, the well casing will come up with the plug. Removing this soil plug from the HSA can be accomplished by drilling and washing out the plug using a rotary bit, or augering out the plug with a solid-stem auger bit sized to fit inside the hollow-stem auger. Use of a knock-out plug is often the preferred technique and can be used where no soil sampling is to be conducted during the drilling process.

Typically, a knock-out plug is wedged into the bottom opening of the HSA between the teeth of the bit. When the appropriate depth for the well has been reached, the knock-out plug is literally knocked out, hence the name, of the bottom opening, at depth, usually by pounding it with a drill pipe or the weight of the well casing until the plug breaks. This can be a very time-consuming process, particularly if the bottom plug becomes tightly wedged into the opening, as happens with certain types of soil. Until the knock-out plug is broken and dislodged from of the HSA opening, the remaining process of installing the well is halted.

A typical knock-out plug used in the industry has a frusto-conical shape, similar to a round plate with sloped or angled sides. It is usually a solid piece of material of sufficient rigidity and thickness to be wedged securely into the HSA auger and displace soil as the HSA drill bit moves through the soil. There are also lipped plugs that have generally vertical sides and an enlarged lip around the bottom edge that sits against the outside of the auger to prevent the knock-out plug from going entirely up into the HSA bore. The material utilized for a knock-out plug can depend upon the purpose of the well, but is typically wood or a high-density plastic material, like HDPE or PVC. The problem arises in that a plug material of sufficient strength to withstand the force of soil being compacted and displaced against the outer surface is also usually of sufficient strength to resist being broken or cracked so as to be removed out of the auger.

BRIEF SUMMARY

The subject invention successfully addresses the above described disadvantages associated with the previously known knock-out plug devices and method of use with hollow stem augers (HSA), and provides certain attributes and advantages, which have not been realized by these known devices. In particular, the subject invention provides a novel, inexpensive, and highly effective improvement to knock-out plugs that provides for effective displacement of soil during drilling and quicker and easier displacement, dislodging, or other removal of the knock-out plug from the HSA once drilling depth is reached.

In accordance with the embodiments of the invention disclosed herein, a knock-out plug is configured as two or more compatibly-shaped sections attached so that they can be fit into an auger opening, but can be collapsed or folded, making the knock-out plug more easily removed from an HSA opening. In one embodiment, the two or more sections are hingedly configured so that application of pressure or force by soil or other material against the bottom or outer surface causes the two or more hinged pieces to be pressed together, resisting separation, and removal or other displacement of the plug from the opening. In a further embodiment, the two or more pieces are held together by a device or by some portion of the material of the plug itself (e.g., a "living hinge") that allows the two or more hinged pieces to fold or collapse into one another when force or pressure is applied to the opposite, top, or interior surface of the plug. Alternatively, the sections can have interlocking components that hold the sections together when force is applied from at least the bottom side, but which allow the sections to separate when force is applied from at least the top side. Thus, when a knock-out plug of the subject invention is emplaced within the opening of a drill bit, the process of drilling, and the force of the soil applied in a direction against the bottom side, keeps the plug in place and the two or more sections aligned and wedged together intact within the auger opening. However, once drilling with the auger is completed, or at whatever point the knock-out plug needs to be removed, force can be applied to the top surface of the knock-out plug, through the HAS bore, will cause the plug to bend, break, or collapse between the two or more plug sections. This can advantageously allow the knock-out plug to be more easily and quickly removed from the auger.

Typically, a knock-out plug is considered a sacrificial element, in that, it will rarely or never be recovered from the bottom of the well hole. Prior to drilling the well, there may be situations where a knock-out plug is installed in the auger opening and subsequently needs to be removed. Certain embodiments of knock-out plugs of the subject invention are removable and reusable because they are not destroyed during the removal process, simply folded or bent. Thus, by folding or bending in the opposite direction, these embodiments of a knock-out plug of the subject invention can be reinstalled. Other embodiments described herein are configured with a breakable connection and, thus, may not be reusable, but would be easier to remove than other knock-out plugs known in the industry.

It should be noted that this Brief Summary is provided to generally introduce the reader to one or more select concepts of the knock-out plugs described below in the Detailed Disclosure in a simplified form. This Summary is not intended to identify key and/or required features of the claimed subject matter. Other aspects and further scope of applicability of the present invention will also become apparent from the detailed descriptions given herein. It should be understood, however, that the detailed descriptions, while indicating specific embodiments of the invention, are given by way of illustration only, since various changes and modifications within the spirit and scope of the invention will become apparent from such descriptions. The invention is defined by the claims below.

BRIEF DESCRIPTION OF DRAWINGS

In order that a more precise understanding of the above recited invention can be obtained, a more particular description of the invention briefly described above will be rendered by reference to specific embodiments thereof that are illustrated in the appended drawings. The drawings presented herein may not be drawn to scale and any reference to dimensions in the drawings or the following description is specific to the embodiments disclosed. Any variations of these dimensions that will allow the subject invention to function for its intended purpose are considered to be within the scope of the subject invention. Thus, understanding that these drawings depict only typical embodiments of the invention and are not therefore to be considered as limiting in scope, the invention will be described and explained with additional specificity and detail through the use of the accompanying drawings in which:

FIG. 6A is an embodiment having three sections held together with a single flexible hinge that goes across the crease between the sections. FIG. 6B is an embodiment having three sections held together by multiple flex hinges across the crease between the sections.

In FIGS. 7C and 7D it can be seen the faces of the sections are next to each other and are joined along the proximal end by the material of the plug. FIG. 7D shows how the plug material between the sections bends or could even break when the plug sections fold. FIG. 7E is an alternative embodiment where a flexible pad, plate, or panel of material is fixedly attached and covers all or most of the top surface of a knock-out plug. The knock-out plug can have two or more sections held together by the plate, where the plate allows the sections to fold or bend along the crease between the sections.

DETAILED DISCLOSURE

The subject invention pertains to embodiments of plugs that can be used with hollow stem augers (HSA). More specifically, the subject invention provides embodiments of knock-out plugs for use within the auger opening of a HSA, where the knock-out plug is capable of resisting the ingress of soil and fluids into the augur stem channel. Still more specifically, the knock-out plug is configured so that it can be more easily removed from the auger, than are standard HSA plugs, by the application of pressure on the knock-out plug to cause the plug sections to fold or collapse along one or more creases.

The following description will disclose that the subject invention is particularly useful in the field of well drilling, in particular the HSA devices used for drilling a well hole specifically for receiving a well-casing. However, a person with skill in the art will be able to recognize numerous other uses to which the devices and methods of the subject invention would be applicable, such as, for example. While the subject application describes, and many of the terms herein relate to, a use for well-drilling with HSA's, other modifications apparent to a person with skill in the art and having benefit of the subject disclosure are contemplated to be within the scope of the present invention. For example, any endeavor which requires a drilled subsurface hole could benefit from the embodiments of the subject invention.

Finally, reference is made throughout the application to the "proximal end" and "distal end." As used herein, the proximal end is that end which, during use, is nearest to, directed towards, or is above the soil surface. Conversely, the distal end is that end which, during use, is furthest from, is directed away from, or is below the soil surface.

The present invention is more particularly described in the examples presented herein that are intended to be illustrative only since numerous modifications and variations therein will be apparent to those skilled in the art. As used in the specification and in the claims, the singular for "a," "an" and "the" include plural referents unless the context clearly dictates otherwise.

Figure 9:
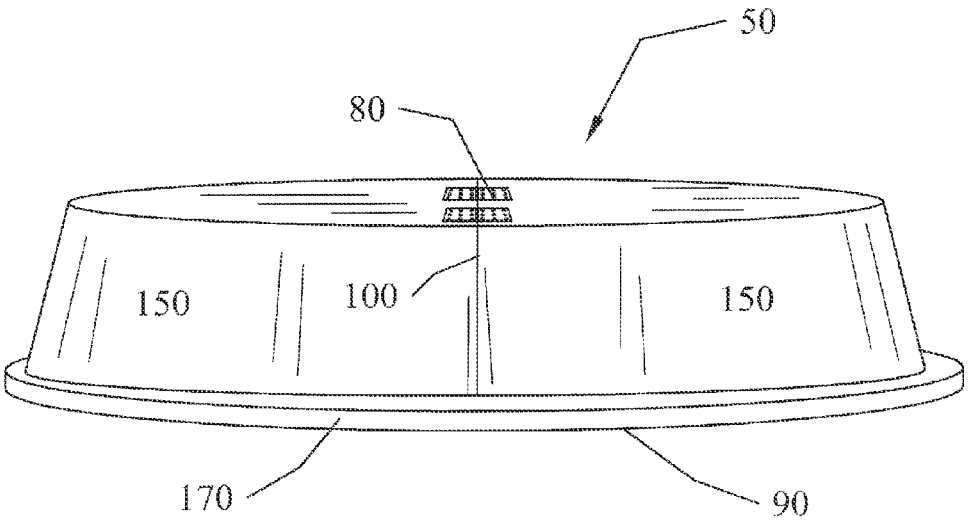
FIG. 9 is a front elevation view of an embodiment of a lipped knock-out plug.
Figure 10:
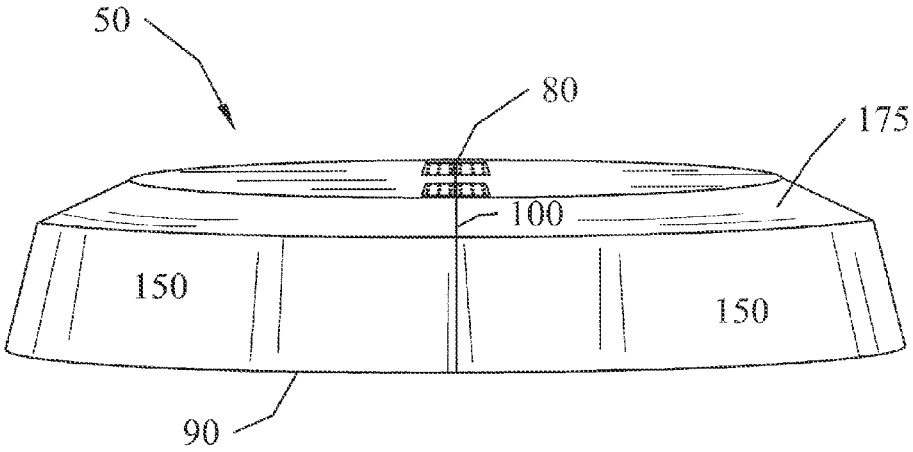
FIG. 10 is a front elevation view of an embodiment of a knock-out plug with a bevel on the peripheral wall.

Reference will be made to the attached figures on which the same reference numerals are used throughout to indicate the same or similar components. With reference to the attached figures, which show certain embodiments of the subject invention, it can be seen that the subject invention comprises a knock-out plug 50 having two or more sections 70 arranged side-by-side or horizontally, so that they form a plate-like structure having a top side 80 at the proximal end 5 and a bottom side 90 at the distal end 10 and at least one face 120 that abut against the at least one face of another section. The two or more sections can be foldably attached over the abutted faces and at or about the top side by a variety of techniques, which will be discussed herein. Alternatively, the two or more sections can be interlocked by several techniques, which will also be discussed herein. The foldable configuration of the sections provides a crease 100 where two section faces 120 come together, so that the crease opens towards the bottom side when the sections fold or collapse and the faces separate. Embodiments include a sloped (FIGS. 1, 6A, and 7E) or a bevel 175 (FIG. 10) on the peripheral wall that can assist in positioning and wedging the knock-out plug within a auger. An alternative embodiment utilizes a lipped plug (FIG. 9), where the sides are generally vertical and bottom side of the peripheral wall has a ridge or lip 170 to inhibit the plug from going completely into the auger. Each of these general components can have one or more sub-components, which will be discussed in detail below.

Currently, the plugs used in auger augers are manufactured from a solid piece of wood or formed as a solid plastic piece, such as, for example, high density polyethylene (HDPE). Other materials can also used, but, because these are sacrificial products, less expensive materials can be preferred. In addition, if the well is intended to be used for environmental monitoring with periodic testing of the water or other fluids therein, the plug should not be a material that degrades into a biological or environmental hazard or a material that can affect the results of tests or samples taken from the well. Whatever material(s) is chosen for a plug, or components thereof, should be sufficiently rigid, strong and the tensile strength to withstand the rigors of drilling, remain within the auger, and resist ingress of soil and water into the augur during the drilling process. While wood and plastics are often the preferred materials, this does not preclude the use of a variety of other materials, such as, for example, latex, ceramics, clay, glass, silicone, metal, rubber, and other materials or combinations thereof. Thus, in the description that follows, it will be understood that a person with skill in the art, having an understanding of the subject invention and knowledge of the purpose for the well being drilled, will be able to determine the one or more appropriate materials for use in manufacturing a knock-out plug embodiment of the subject invention. Such variations which provide the same function, in substantially the same way, with substantially the same results are within the scope of this invention.

Most HSAs have a auger with a circular periphery. Thus, a knock-out plug of the subject invention can also have a peripheral shape 54 that is substantially circular. In instances where the auger is not circular, a knock-out plug can be configured to have a peripheral shape that conforms to the shape of the auger. It is within the skill of a person trained in the art to determine the appropriate peripheral shape for a knock-out plug, circular or otherwise, that incorporates one or more of the embodiments, features, or characteristics discussed herein. Such variations are within the scope of this invention. For the sake of literary convenience, the description herein will be based on a knock-out plug having a circular periphery.

With regard to the embodiments of a knock-out plug 50 of the subject invention, there can be at least two sections 70 that form a knock-out plug. As mentioned above, the purpose of a knock-out plug is to prevent or at least inhibit soil, water, rocks and other material in the subsurface terrain from entering into the hollow bore 260 of the auger 250 during drilling. Thus, it can be advantageous for the knock-out plug to have a peripheral shape 54 that conforms to the shape of the auger 260 within the drill bit 250, as mentioned above.

Figure 4A:
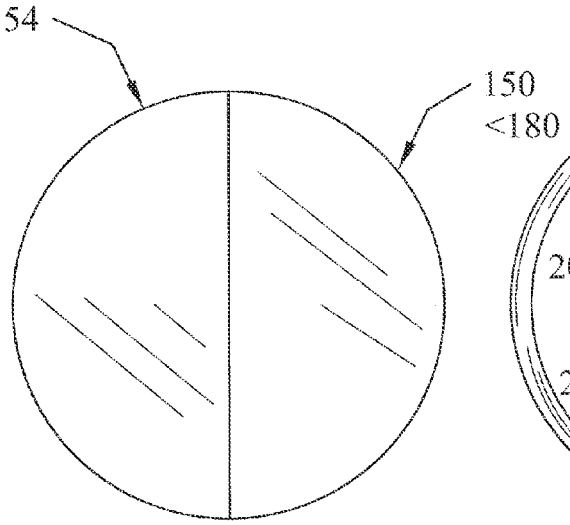
FIG. 4A is an illustration of a bottom plan view of a knock-out plug embodiment according to the subject invention. In this view, the sections are substantially horizontal, such that the bottom side of each section is generally coplanar.
Figure 4B:
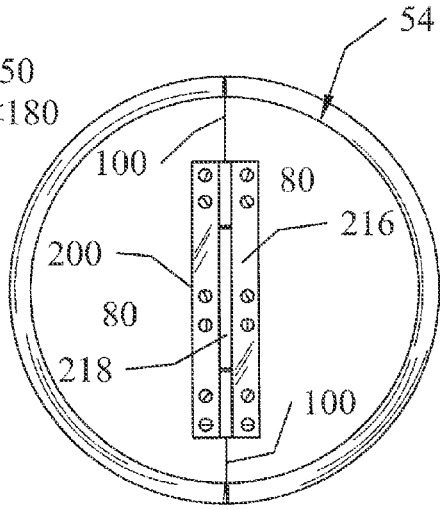
FIG. 4B is an illustration of a top plan view of a knock-out plug embodiment according to the subject invention. In this view, the sections are substantially horizontal, such that the top side is generally coplanar.

In one embodiment, a knock-out plug has two sections 70. In a further embodiment, the two sections are semi-cylindrical in shape, such that the periphery forms an arc 52 of approximately 180° when viewed from the bottom side 90 of the knock-out plug, such as shown, for example, in FIG. 4A. Each plug section has a face 120 where they come together to form a crease 100, which is illustrated by way of example in FIGS. 1, 2, 7C, and 7D. The faces can be flat or substantially flat, as shown in the example in FIG. 2. Alternatively, the faces can have any of a variety of interdigitating features 125 that fit or conform to each other when the faces come together, one non-limiting example of which is shown in FIGS. 8A and 8B. Such interdigitating features can also assist in holding the faces together during drilling, but will not, ideally, inhibit removal of the knock-out plug from the auger when force is applied to the top side 80. With this embodiment, the plug sections are fit together, with their faces together and forming a crease, so that the knock-out plug has a substantially circular peripheral shape 54, as seen in FIGS. 4A and 4B.

Figure 6A:
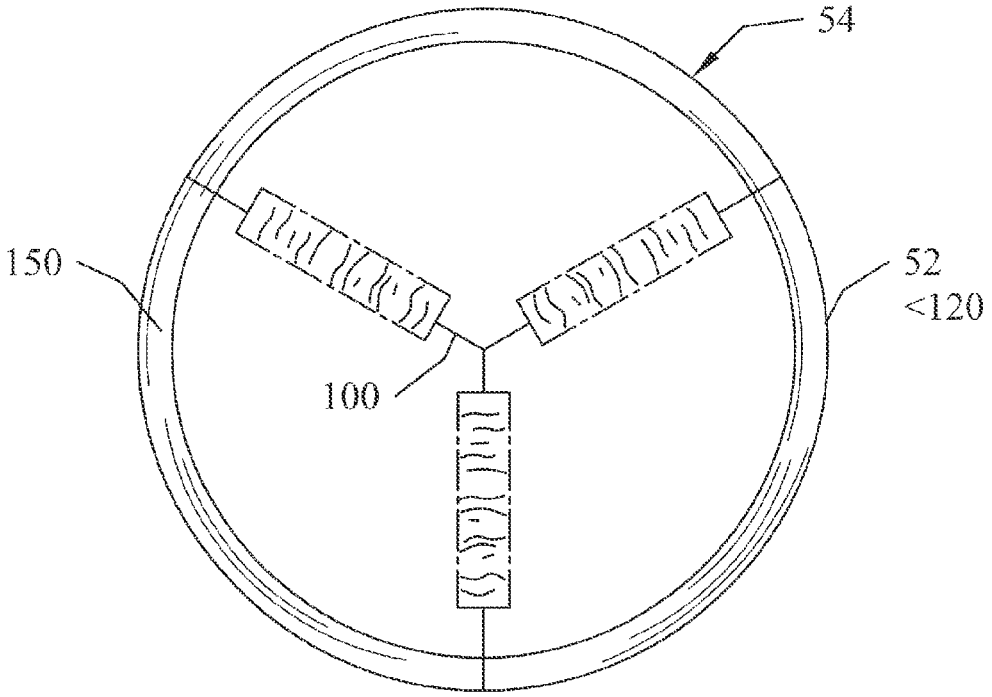
FIGS. 6A and 6B are top plan views of alternative knock-out plug embodiments having more than two sections.
Figure 6B:
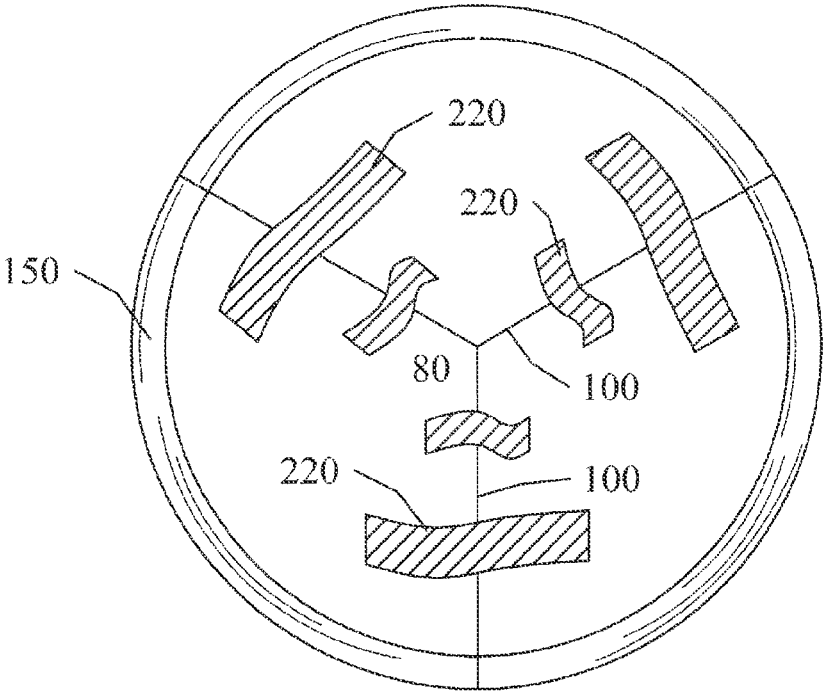

In another embodiment, a knock-out plug has three sections 70. In a further embodiment, the three sections are semi-cylindrical in shape, such that the peripheral wall 150 forms an arc 52 of approximately 120° when viewed from the bottom side 90 of the knock-out plug. Alternatively, the sections can have different peripheral arcs, such that one or more can be less than or greater than 120°, as long as the arc total is as close as possible to 360°. One non-limiting example of a plug having three sections is shown in FIGS. 6A and 6B. Each of the three sections can have two faces that each come together with one of the two faces on the other sections. Not unlike a pie cut into three pieces. When the knock-out plug sections come together, the faces form a crease and the peripheral shape 54 is, again, substantially circular. There can also be interdigitating features 125, as described above, on one or more of the faces.

A plug can also have more than three sections, provided that the sections can be fit together in a fashion that will hold them securely during drilling and allow them to be knocked out of the auger by applying force to the top side 80 of the plug. Each of these sections can have features as described above for the two and three section knock-out plugs and should have a peripheral shape 54 that conforms to the shape of a auger.

Further, it should be understood that the sections of a knock-out plug can be, but are not required to be, identical size, shape, or be mirror images of each other. Thus, one section of a knock-out plug can be larger than another section or have a slightly different peripheral shape, or they can have a different peripheral arc or other differences, such that they are not identical or mirror images. By way of non-limiting example, for a plug with two sections, the crease does not necessarily have to be centered on the plug. In FIG. 4A, the crease 100 is shown centered on the plug, but could also be off-center, such that one section is smaller or has a smaller peripheral arc than the other section. By way of further non-limiting example, for a plug with three sections, the point where they converge does not necessarily have to be centered on the plug. In FIGS. 6A and 6B, the creases between the three sections are shown meeting in the center of the plug, but they could converge at a point that if off-center, such one or more sections are a different size or have a different peripheral arc than another section.

Figure 3:
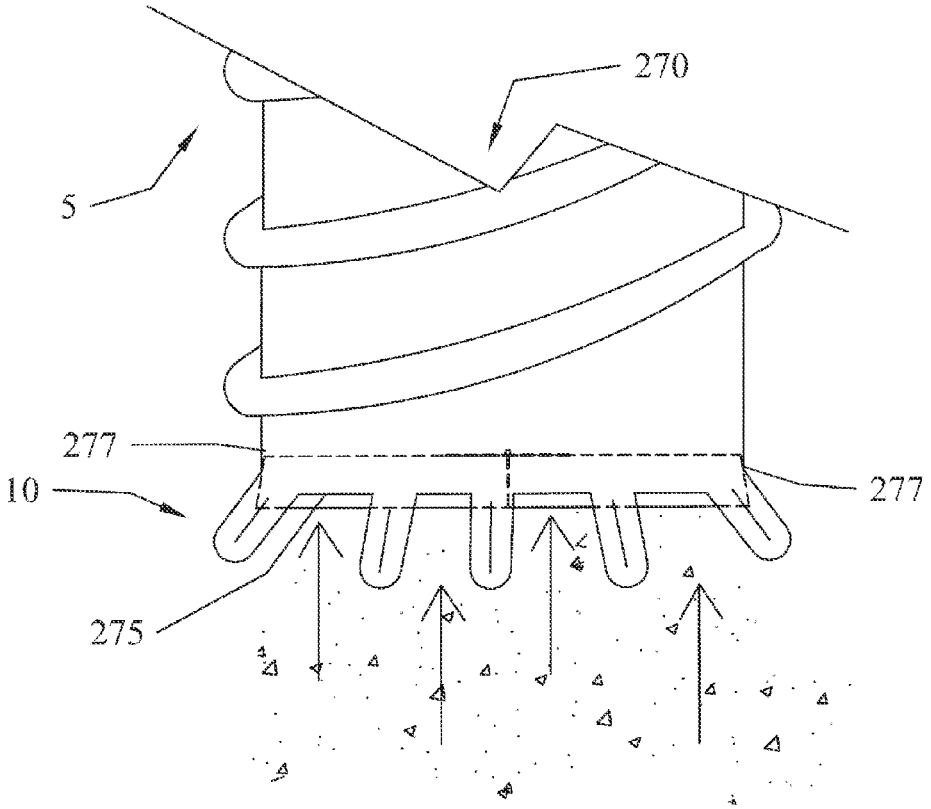
FIG. 3 is an illustration of a HSA with a knock-out plug, according to the subject invention, wedged into the auger opening. The arrows in the figure indicate the direction of force applied by soil as the HSA is drilled into the substrate. The application of force by the soil keeps the knock-out plug sections in a horizontal orientation, so the knock-out plug remains wedged into the auger.

With regard to the auger, FIG. 3 illustrates a typical auger as it moves through the subsurface soil. The arrows in FIG. 3 indicate the direction of force applied against a plug wedged into the auger. It is important that the knock-out plug remain at or near the distal end 10 of the auger, so that it can be more easily knocked-out of the auger. The auger bore 270 is often a straight-walled channel with few or no obstructions therein, which could interfere with the placement of a well casing.

Figure 1:
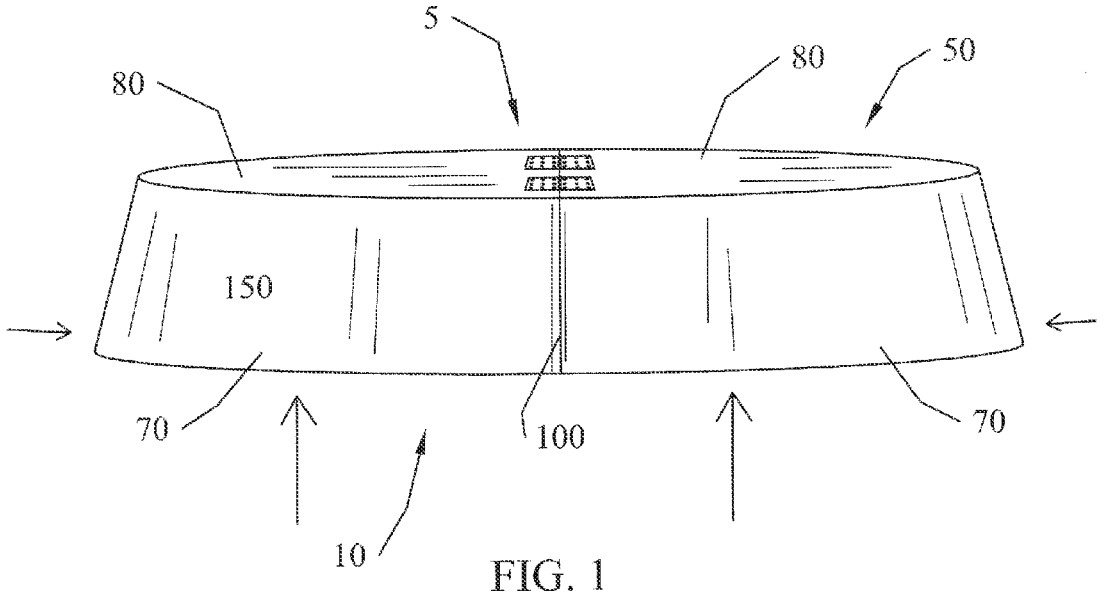
FIG. 1 is an illustration of a knock-out plug, according to embodiments of the subject invention, positioned for placement within a hollow stem auger (HSA) auger. The arrows in the figure indicate the direction of force that maintains the knock-out plug in the auger.
Figure 7A:
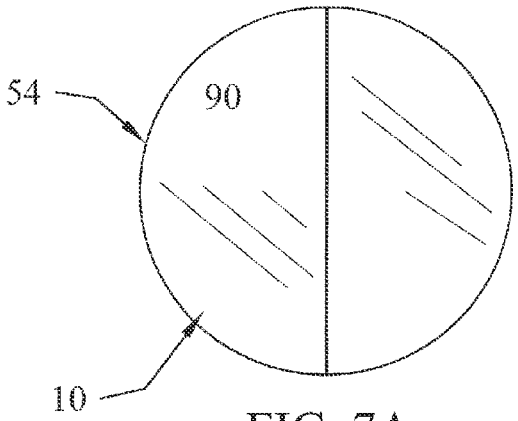
FIGS. 7A and 7B are bottom plan and top plan views, respectively, of an embodiment employing a "living hinge," that is, a hinge formed by a cut made into the material of the knock-out plug, such that the hinge is incorporated as part of the plug.
Figure 7B:
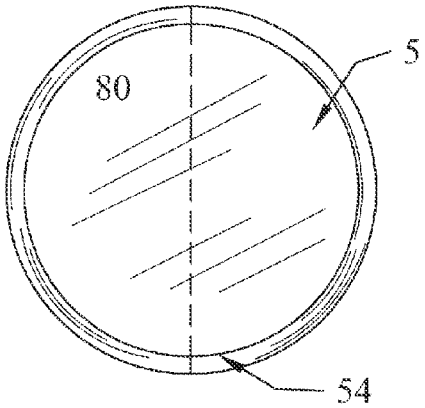
Figure 7C:
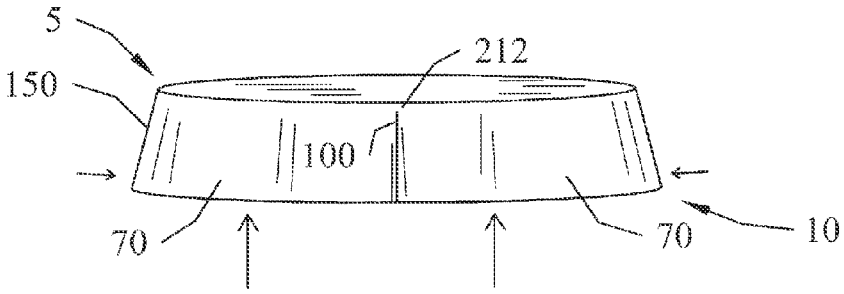
FIGS. 7C, 7D, and 7E are side elevation views of the embodiment shown in FIGS. 7A and 7B.
Figure 8A:
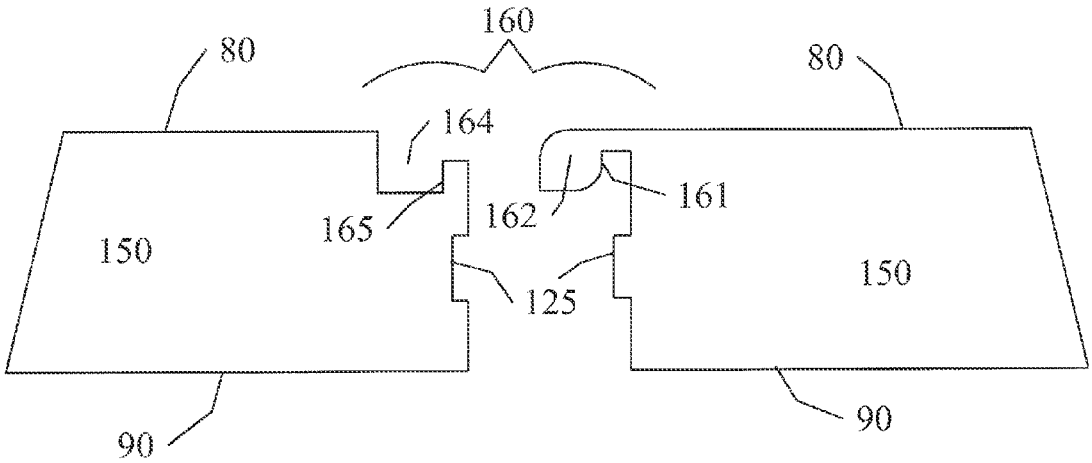
FIGS. 8A and 8B are front elevation views of one embodiment of a knock-out plug that utilizes tongue-and-groove configurations for attachment of the plug sections. With this embodiment, the "tongue" portion on one section can fit into the "groove" on another section. The tongue-and-groove can be designed so that they hold the sections together during drilling and the application of force to the bottom surface, but allow the sections to fold or come apart when force is applied against some part of the top surface.
Figure 8B:
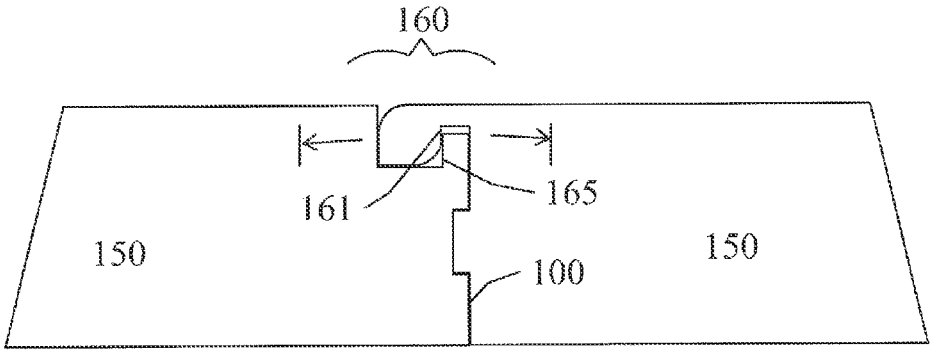

One embodiment of a knock-out plug of the subject invention has a peripheral wall that is sloped, where the circumference of the bottom side 90 is greater than the circumference of the top side 80, examples of which are shown in FIGS. 1 and 7C. Alternatively, the peripheral wall 150 can be beveled 175, where only part of the wall is angled or not coplanar with the rest of the wall, as shown, for example in FIG. 10. In a further embodiment, the circumference of the bottom side is greater than the typical circumference of an auger. This provides the advantage of being able to fit the top side of the knock-out plug into the auger, but inhibits the bottom side from fitting into or fitting too closely into the auger. While the knock-out plug can be wedged into the auger, the large diameter or larger circumference of the bottom side will inhibit the plug from going entirely into the auger. An example of this is shown in FIG. 3.

The dimensions of knock-out plug embodiments of the subject invention can be the same or similar to those of standard knock out plugs currently used in the field. Thus, a person with skill in the art would be able to determine an appropriate thickness (top side to bottom side) and circumference and/or diameter that would be appropriate for the given circumstances. Ideally, the slope of or bevel 175 on a knock out plug will cause the plug to wedge against the edge of auger at about one-half of the thickness of the plug. Thus, for example, a plug that is about 3" thick will wedge within the auger at about 1.5" below the top surface. Oftentimes, the diameter of a drilled well is made larger than the diameter of a well-casing. Depending upon the purpose of the well, the diameter can be just a few to several inches, as can be the auger. Currently, augur plugs have internal diameters or top side diameters that range in size from about 2" to about 12", which match the most common sizes of HSAs used in the field.

The embodiments of the subject invention can also have a similar range of top side diameters. The thickness of a knock-out plug can also vary, often depending upon the type of material utilized for the plug. In one embodiment, a knock-out plug manufactured from a suitable type of wood has a thickness of between approximately 1.5" and 2.5" and a top side 90 diameter of between approximately 9" and approximately 11". In one particular embodiment, useful for larger HSAs, a wooden knock-out plug has a thickness of approximately 2.0" and a top side diameter of approximately 10.25".

Lipped knock-out plugs can also be used with the embodiments of the subject invention. Lipped plugs can have straight, parallel, peripheral walls and a lip 170 or ridge around the bottom side of the peripheral wall, as shown in the example in FIG. 9. The lip presses against the auger edge 277 and keeps the plug from becoming jammed into the opening. The dimensions of a lipped knock-out plug will depend upon the size of the auger 250 and other factors known to those with skill in the art. Variations in the dimensions of a lipped plug are within the scope of this invention.

For a knock-out plug of the subject invention to be useful, it must hold together in the augur auger during drilling. Otherwise, if the sections fall apart, they can block the auger bore, inhibit drilling, allow ingress of soil, water, rocks, and other material into the bore, and may even cause damage to the drill bit itself. There are several techniques by which the sections of a knock-out plug can be held together so that they resist force against the bottom side and stay in place within the auger, but succumb relatively easily to force applied to the top side and fall apart or separate.

One embodiment utilizes a tongue-and-groove 160 configuration to hold the sections together. With this embodiment, one section has a tongue 162 that can fit into a compatible groove 164 on another section. The tongue-and-groove configuration can be most beneficial when utilized with a sloped peripheral wall or a bevel 175 on the peripheral wall of the knock-out plug, because the force applied by the auger edge 277 to the peripheral wall of the knock-out plug during the drilling process can further assist in holding the plug sections together. A tongue-and-groove knock-out plug is not, however, limited to use with only a sloped peripheral wall and can be adapted for use with a lipped or other type of knock-out plug.

There are numerous types of tongue-and-groove configurations that can be employed with knock-out plug embodiments of the subject invention with or without sloped peripheral walls. Embodiments can also have more than one tongue-and-groove on a knock-out plug. Ideally, any tongue-and-groove configuration that resists bottom side forces and succumbs to top side forces would be most advantageous. In a further embodiment, a tongue-and-groove 160 configuration can be combined with an interdigitating feature 125 to more fully ensure that the sections remain aligned and combined during installation and use. FIGS. 8A and 8B illustrate one possible configuration that utilizes both a tongue 162 on one section 70 that fits into a corresponding groove 164 on another section and a mortis and tenon style interdigitating feature 125 on the section faces 120.

Tongue-and-groove configurations often operate by fitting the tongue into a groove and rotating the pieces until surfaces on each section come together to prevent further rotation. On a knock-out plug of the subject invention this can be the faces 120 on each section. There are also usually at least two opposing surfaces in a tongue-and-groove arrangement, a tongue surface 161 and groove surface 165, that also abut to inhibit the sections from being pulled apart horizontally. A non-limiting example of this is shown in FIGS. 8A and 8B. Tongue-and-groove configurations are well-known in the art. Variations that provide the same functions, in substantially the same way, with substantially the same result are within the scope of this invention.

Figure 2:
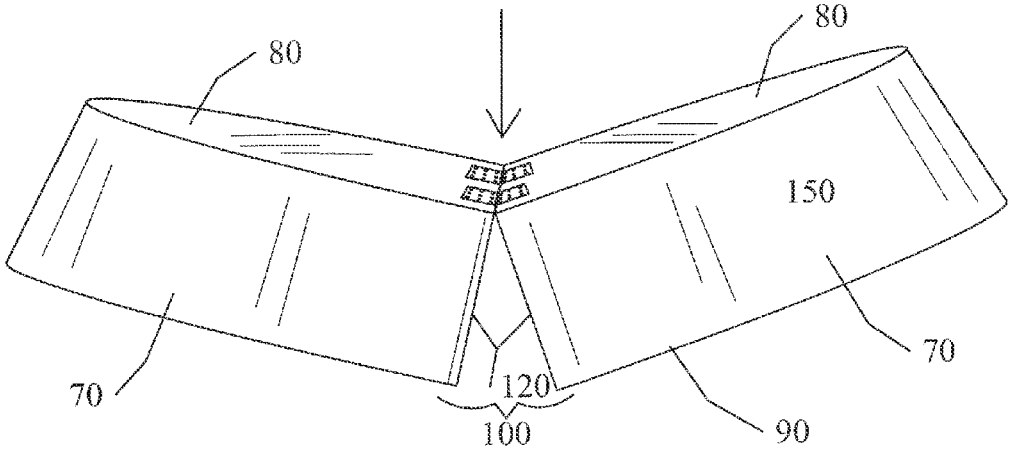
FIG. 2 is an illustration of a knock-out plug, according to embodiments of the subject invention, in a bent configuration for removal from the auger opening of a HSA. The arrow in the figure indicates the direction of force that causes the knock-out plug sections to fold or collapse along a crease.

In another embodiment, one or more hinges 200 are used to join the sections 70 of a knock-out plug 50. At least one hinge can be placed on the top side 80 of the plug so that it crosses over at least part of the crease 100. A hinge can allow the sections 70 of a knock-out plug 50 to rotate towards the top side 80. During the drilling process, when the knock-out plug is installed within a auger 275, as demonstrated in FIG. 3, force applied to the bottom surface will wedge the plug into the opening and force the sections to remain together while a hinge can prevent separation of the sections at the top side 80. However, when force is applied to the top surface, there can be nothing to prevent the section faces 120 from separating on the bottom side 90 and allowing the entire plug to fold or collapse towards the top side, as shown in FIG. 2. This is advantageous as it allows the plug to be easily removed from the auger when force is applied to the top side. Usually less force is required with the embodiments of the subject invention than is necessary with knock-out plugs currently known in the art. A hinge can be affixed to a knock-out plug by any method or device known to those with skill in the art, including, but not limited to, nails, screws, tacks, adhesives, tape, heat sealing, pressure crimping, pressure fittings, or other materials, devices, techniques, or combinations thereof. Any variations in attachment of a hinge, which provide the same functionality, in substantially the same way, with substantially the same results are within the scope of this invention.

With regard to the type of hinge that can be used there are a variety of options known in the art. A hinge can be a separate component attached to the top side of the plug sections. Alternatively, a "living hinge" can be configured into the plug sections, where the hinge is formed as part of the plug, often from the same material as the plug. Whatever type of plug is used, it should have at least sufficient tensile strength to withstand the force or forces applied to the knock-out plug to prevent the sections from separating along the crease on the top side.

The factors that can be considered by those skilled in the art with regard to the choice of materials for a knock-out plug and sections thereof have been discussed above and are reasserted here with regard to hinges. In a particular embodiment, a hinge is comprised of a high-density plastic material. In a specific embodiment, the hinge is comprised of high-density polyethylene (HDPE) or a polyvinylchloride (PVC).

Figure 5A:
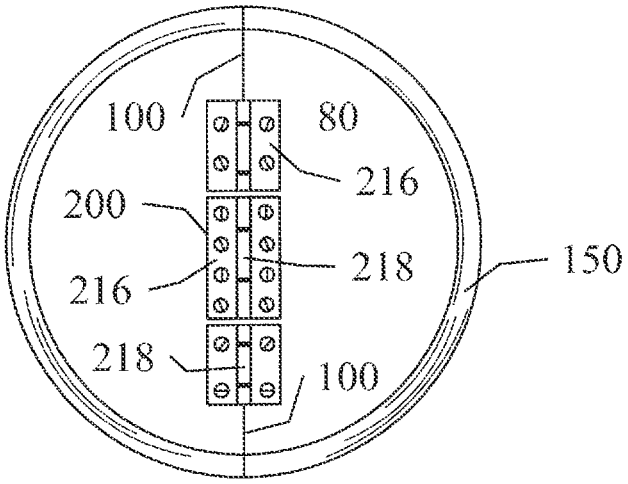
FIGS. 5A, 5B, and 5C are top plan views of alternative knock-out plug embodiments according to the subject invention. In these views, the sections are substantially horizontal, such that the top sides are coplanar and the peripheral walls are substantially aligned.
Figure 5B:
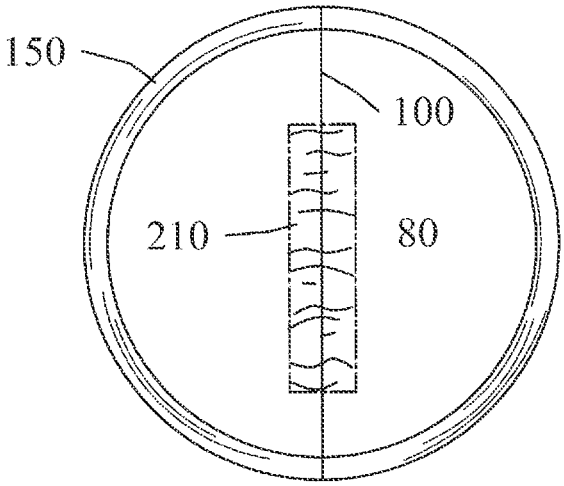

In one embodiment, the hinge is formed of the same material as the knock-out plug sections and is contiguous with the overall plug or transitions into the material of the plug, such that there is little or no obvious line of demarcation between the hinge and the material of the plug. This is often referred to as a living hinge. One example of this is shown in FIGS. 5B and 6A. Alternatively, the hinge could be a material that is similar to or at least capable of being incorporated as a living hinge into the material of the knock-out plug. For example, the plug and hinge could be two plastics that are molded together.

There are numerous materials that are flexible and/or frangible when formed into or made into a thin layer, but which achieve less flexibility or frangibility as the thickness or amount of material in a layer or sheet increases. By way of example, certain plastics or wood can be very flexible or frangible when formed or cut into thin sheets or layers. However, these same materials, when made into a thicker layer or sheet, can be less flexible or less frangible.

Figure 7D:
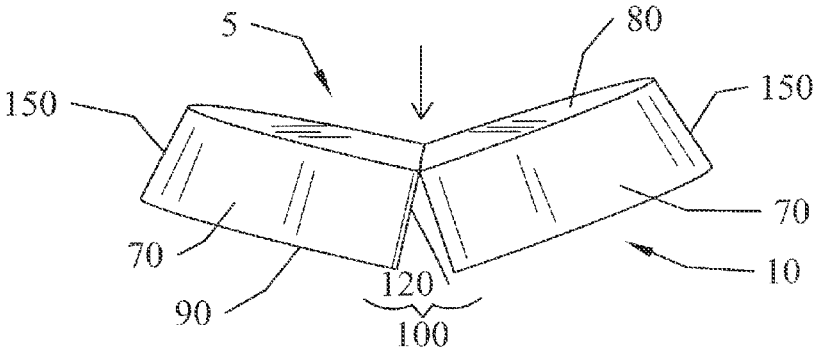
Figure 7E:
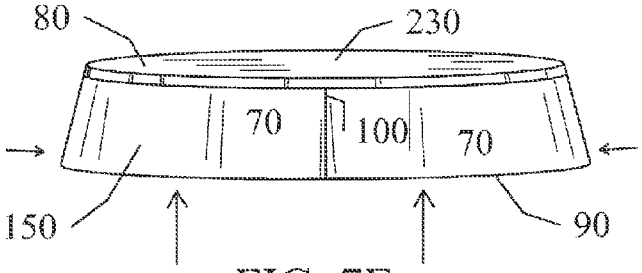

In a particular embodiment, a knock-out plug 50 is formed from such a material that has variable flexibility or frangibility depending on the thickness of the material. In a further embodiment, the knock-out plug can be cut or severed by any means known in the art, such that a crease 100 is formed across the bottom side and through the material of the knock-out plug to a point just before or just below the top side. This can provide a thin layer 212 of the material between the top side 80 and the peripheral end 5 of the crease 100 where the plug was not cut. FIGS. 7A-7D illustrate a non-limiting example of this embodiment. This thinner layer of material can be equivalent to a living hinge 210. Depending upon the type of material utilized, this living hinge can bend or break when force is applied to the peripheral end 5 or the top side 80 of the plug, as shown in FIG. 7D. When the plug is installed within a auger, the force applied by the drill bit edge 277 against the peripheral wall 150 can push the distal ends of the sections 70 together and the living hinge can hold the top side of the sections together.

In another embodiment, a hinge can be any of a variety of standard barrel hinges 215 known in the art. These types of hinges have at least two leaf 216 parts joined by a barrel 218 that allows each leaf to rotate relative to the other. Each leaf can be attached to different sections of a knock-out plug so that the crease is between them and approximately centered with and parallel with the barrel. Examples of this type of hinge on a knock-out plug are shown in FIGS. 1, 2, 4B and 5A. The ability to install a barrel hinge is within the capability of one of ordinary skill in the art and will not be described in further detail here.

Figure 5C:
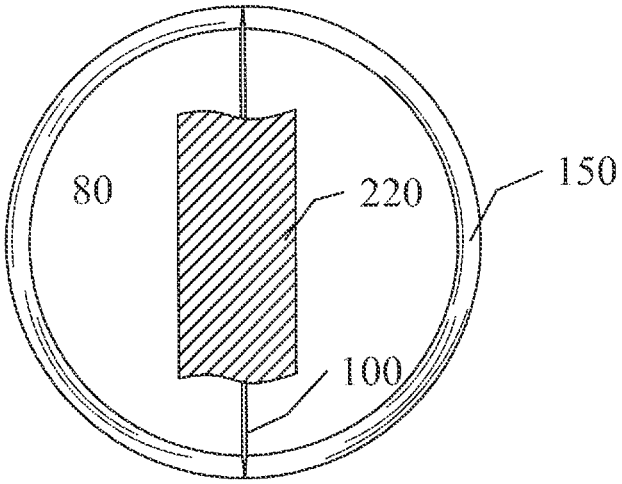

Yet another embodiment can employ at least one flex hinge 220 comprised of any of a variety of flexible or pliable materials that have sufficient tensile strength to prevent separation of the sections 70 along the top side, as discussed above. FIGS. 5C and 6B illustrate non-limiting examples of sections of a knock-out plug joined with one or more flex hinges 220. The factors to be considered with regard to the material of a flex hinge are the same as those discussed above for other components of a plug or other types of hinges. A flex hinge can be attached by any method known to those with skill in the art so that it goes over the crease and prevents separation of the plug sections along the top side. Ideally, the flex hinge is attached firmly or with minimal tolerance to the top side, so that when the faces are abutted, the knock-out plug sections are accurately, horizontally aligned. This can inhibit jamming or misalignment of the plug during use.

In one embodiment, a single flex hinge is affixed over the crease between plug sections 70, as shown, for example, in FIG. 5C. In an alternative embodiment, multiple flex plugs are affixed over the crease between plug sections, as shown, for example, in FIG. 6B. In a particular embodiment, shown, by way of example, in FIG. 7E, a flex plug is a flexible plate 230 having a pre-determined thickness, depending upon the material utilized, which can be affixed to cover most or all of the entire top side. The tensile strength of the material can be such that it holds the knock-out plug 50 sections 70 together across the top side, as the plug is forced into the auger, but the flexibility allows the sections to fold or collapse when force is applied to the plate 230. In a specific example, a plate 230 is manufactured from a HDPE plastic or similar type of material. The plate can have a thickness of between approximately 2 mm and approximately 20 mm. The HDPE has sufficient tensile strength to prevent top side separation of the sections, but has sufficient flexibility to allow bending between the crease when the sections fold or collapse away from the auger.

Wells that are drilled for the purpose of installing a well-casing require a hole that is clear of soil, liquids, and other debris. Usually, a hollow stem auger (HSA) is used to drill a hole and a plug is placed within the auger opening to prevent the displaced soil and debris from entering the hollow channel. These plugs can become severely impacted into the auger opening, making it difficult and time-consuming to remove them by "knocking" or pounding them out of the opening prior to placing the well-casing. The embodiments of the subject invention provide knock-out plugs that are creased so that they can be bend or fold when force is applied to the top side of the plug. Placement within the auger opening ensures that the plug remains intact and the sections held together. A hinge on the top side, across the crease, further prevents the sections from separating. The ability of the hinge to bend or break makes removing the knock-out hinge easier and less time-consuming to remove.

All patents, patent applications, provisional applications, and other publications referred to or cited herein are incorporated by reference in their entirety, including all figures and tables, to the extent they are not inconsistent with the explicit teachings of this specification. Additionally, the entire contents of the references cited within the references cited herein are also entirely incorporated by reference.

The examples and embodiments described herein are for illustrative purposes only and that various modifications or changes in light thereof will be suggested to persons skilled in the art and are to be included within the spirit and purview of this application.

Any reference in this specification to "one embodiment," "an embodiment," "example embodiment," "further embodiment," "alternative embodiment," etc., is for literary convenience. The implication is that any particular feature, structure, or characteristic described in connection with such an embodiment is included in at least one embodiment of the invention. The appearance of such phrases in various places in the specification does not necessarily refer to the same embodiment. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

The invention has been described herein in considerable detail, in order to comply with the Patent Statutes and to provide those skilled in the art with information needed to apply the novel principles, and to construct and use such specialized components as are required. However, the invention can be carried out by specifically different equipment and devices, and that various modifications, both as to equipment details and operating procedures can be effected without departing from the scope of the invention itself. Further, although the present invention has been described with reference to specific details of certain embodiments thereof and by examples disclosed herein, it is not intended that such details should be regarded as limitations upon the scope of the invention except as and to the extent that they are included in the accompanying claims.

I claim:

1. A knock-out plug, adapted to be used with an auger, comprising:

a first and a second section, where each section comprises a top side, a bottom side, and a face, where the one face of the first section is directed towards a face of the second section to form a crease between the faces and a peripheral wall around the knock-out plug;

a hinge fixedly positioned on or about the top side of the sections, where the hinge crosses the crease so that hinge holds the sections with their faces directed towards each other, such that, when the knock-out plug is installed within the auger, with the peripheral wall in contact with an auger bore, the sections are held with the faces directed towards each other, and when a force is applied to a top side of at least one section, the hinge bends or breaks and allows the plug sections to fold along the crease causing the knock-out plug to be dislodged from the auger.

2. A knock-out plug according to claim 1, wherein the peripheral wall is sloped, so that the top side has a smaller diameter than the bottom side.

3. A knock-out plug according to claim 2, wherein the hinge is a living hinge.

4. A knock-out plug according to claim 3, wherein the living hinge is a plate fixedly attached to the top side.

5. A knock-out plug according to claim 2, wherein the hinge is a barrel hinge having at least two leaf parts attached to the respective first and second sections.

6. A knock-out plug according to claim 2, wherein the hinge is a flex hinge.

7. A knock-out plug, according to claim 1, wherein the first section and the second section have different peripheral wall arcs.

8. A knock-out plug, adapted to be used with an auger, comprising:

a first and a second section, where each section comprises a top side, a bottom side, and a face, where the face of the first section is directed towards the face of the second section to form a crease between the faces and a peripheral wall around the knock-out plug;

a tongue-and-groove connection comprising a tongue on a first section and a groove on a second section, where the tongue-and groove connection is at or near to the top side of the two sections, so that tongue-and-groove connection holds the sections with their faces directed towards each other, such that, when the knock-out plug is installed within the auger, with the peripheral wall in contact with an auger bore, the sections are held with the faces directed towards each other, and when a force is applied to the top side of at least on section, the tongue-and-groove connection separates allowing the plug sections to fold along the crease causing the knock-out plug to be dislodged from the auger.

9. A knock-out plug, according to claim 8, further comprising a tongue opposing surface on a first section and a groove opposing surface on another section, such that when the sections are engaged, the tongue opposing surface and the groove opposing surface inhibit the first section and the second section from being pulled apart.

10. A knock-out plug, according to claim 8, further comprising one or more interdigitating features on the face of the first section and the face of a second section.

11. A knock-out plug, according to claim 8, wherein a first section and a second section have different peripheral wall arcs.

12. A kit for drilling a well, the kit comprising:

an auger having an opening at the distal end that leads into an auger bore; and a knock-out plug according to claim 1 that is removably engaged with the opening in the auger.

13. A kit, according to claim 12, wherein the peripheral wall of the knock-out plug is sloped, so that the top side has a smaller diameter than the bottom side.

14. A kit, according to claim 13, wherein the hinge on the knock-out plug is a living hinge.

15. A kit, according to claim 13, wherein the hinge is a plate fixedly attached to the top side.

16. A kit, according to claim 13, wherein the hinge is a barrel hinge having at least two leaf parts attached to the respective first and second sections.

17. A kit, according to claim 13, wherein the hinge is a flex hinge.

18. A kit for drilling a well, the kit comprising:

an auger having an opening at the distal end that leads to an auger bore; and a knock-out plug according to claim 8 that is removably engaged with the opening in the auger bore.

19. A kit, according to claim 18, further comprising a tongue opposing surface on a first section and a groove opposing surface on another section, such that when the sections are engaged, the tongue opposing surface and the groove opposing surface inhibit the first section and the second section from being pulled apart.

20. A kit, according to claim 19, further comprising one or more interdigitating features on the face of a first section and the face of a second section.

21. A method for drilling a well comprising:

selecting an auger for use in drilling the well;

installing within a distal opening in the auger a knock-out plug, according to claim 1, such that the knock-out plug is lodged in place within the opening;

utilizing the auger to drill the well to a desired depth; and applying force to the top side of the knock-out plug, while the auger is within the well, so that the faces of the sections separate along the crease causing the knock-out plug to become dislodged from the distal opening in the auger.

* * * * *